US010883785B1

(12) United States Patent
Rophael et al.

(10) Patent No.: US 10,883,785 B1
(45) Date of Patent: Jan. 5, 2021

(54) GUN BARREL EQUIPPED WITH ALTERNATING VARIABLE PITCH RIFLING

(71) Applicant: U.S. Government as Represented by the Secretary of the Army, Picatinny Arsenal, Dover, NJ (US)

(72) Inventors: David Rophael, Lafayette, NJ (US); Adam L. Foltz, Long Valley, NJ (US)

(73) Assignee: U.S. Government as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/570,212

(22) Filed: Sep. 13, 2019

(51) Int. Cl.
*F41A 21/18* (2006.01)

(52) U.S. Cl.
CPC ..... *F41A 21/18* (2013.01)

(58) Field of Classification Search
CPC ..... F41A 21/18
USPC ..... 42/78
See application file for complete search history.

(56) References Cited

U.S. PATENT DOCUMENTS 128,446 A * 6/1872 Winchester ..... F41A 21/18 42/78
300,515 A * 6/1884 Schneider ..... F41A 21/18 42/78
3,525,172 A * 8/1970 Costa ..... F41A 21/16 42/78
4,924,614 A * 5/1990 Hoffmann ..... F41A 21/18 42/78
5,077,926 A 1/1992 Krumm
5,337,504 A * 8/1994 Krumm ..... F41A 21/18 42/78
H001365 H * 11/1994 Amspacker
5,765,303 A 6/1998 Rudkin
5,819,400 A * 10/1998 Sargeant ..... C25F 7/00 29/825
5,894,770 A 4/1999 Rudkin
6,170,187 B1 * 1/2001 Herrmann ..... F41A 21/18 42/78
6,739,083 B2 * 5/2004 Martin ..... F41A 21/16 42/78
7,254,913 B2 8/2007 Dubois
7,802,394 B1 * 9/2010 Bartoli ..... F41A 21/18 42/78

(Continued)

OTHER PUBLICATIONS

Anderson, Tim; Twist Rate 101: Understanding Rifling and Twist Rate Basics; May 1, 2015; https://www.ballisticmag.com/2015/05/01/rifling-101-understanding-twist-rate-basics/ (Year: 2015).*

*Primary Examiner* — Joshua E Freeman
(74) *Attorney, Agent, or Firm* — John P. Di Scala

(57) ABSTRACT

A rifled weapon barrel has increases the piezometric efficiency of the weapon system with varying rifling profiles throughout the barrel to maximize useful work out of the propellant gases. The weapon barrel includes a first rifling section at the breech end which progressively increases in twist rate to induce a torque spike on the projectile and maximize chamber pressure. Next, the weapon barrel includes a second rifling section which progressively decreases the twist rate to a level that may be unsuitable for aerodynamic stability but provides relief from the torque spike while minimizing pressure loss behind the projectile. Finally, the rifle then maintains this twist rate or decreases to increase stability of the projectile before exit.

17 Claims, 3 Drawing Sheets

(56) References Cited

U.S. PATENT DOCUMENTS

| | | | | |
|---|---|---|---|---|
| 8,635,797 | B2 | 1/2014 | Chu | |
| 2001/0027619 | A1* | 10/2001 | Randall | F42B 35/00<br>42/76.01 |
| 2012/0192475 | A1* | 8/2012 | Cha | F41A 21/18<br>42/78 |
| 2015/0007479 | A1* | 1/2015 | Kunau | F41A 21/18<br>42/78 |
| 2019/0271519 | A1* | 9/2019 | Cleary | F41A 21/18 |

* cited by examiner

GUN BARREL EQUIPPED WITH ALTERNATING VARIABLE PITCH RIFLING

STATEMENT OF GOVERNMENT INTEREST

The inventions described herein may be manufactured, used and licensed by or for the United States Government.

FIELD OF THE INVENTION

The invention relates in general to weapon systems and in particular to weapon systems with rifled barrels.

BACKGROUND OF THE INVENTION

The piezometric efficiency of a weapon system is the ratio of average pressure to peak pressure. Traditional gun tubes exhibit poor piezometric efficiency due to chamber survivability and manufacturing concerns. This results in a heavier than necessary weapon and significant erosion concerns in gun chambers. While there have been many attempts to boost the piezometric efficiency of guns to maximize the useful work from a given volume of burning propellant, there are downsides associated with current approaches.

One approach is the use of a traveling charge concept, wherein unburnt propellant is either carried by the projectile and combusted later in the interior ballistic cycle. Another approach is the use of liquid propellants. Both of these approaches involve severe structural problems or complex launch packages that are not suitable for battlefield conditions.

Other methods to achieve a greater piezometric efficiency include the use of a tapered bore, in which an enlarged projectile gets squeezed to a smaller caliber during the interior ballistic cycle. This increases the expansion ratio of the gun while maintaining projectile weight and charge-to-mass ratios. However, these types of guns require specialized skirted projectiles that can simultaneously obturate and still deform to the final geometry. There have been limited successful tests and models, but these guns exhibit greater muzzle pressure, resulting in excessive muzzle blast and excessive shot-to-shot variability.

Rifling has been used as the predominant way to adjust interior ballistic parameters given a fixed volume and type of propellant. The most prevalent rifling profiles in common use are constant-twist and progressive-twist rifling. Constant-twist is the traditional method and is primarily concerned with achieving sufficient twist at the muzzle for aeroballistic stability. Its pressure-time curve is characterized by a large spike in pressure which quickly dies down and tapers back to atmospheric upon projectile exit. Its torque curve follows a similar shape.

Progressive-twist rifling is used to reduce the torque on the projectile as it enters the rifling, allowing it to spin up to final spin rate along the entire length of the barrel. This allows for lower chamber pressures for a given charge weight; as a result, more propellant is used to maximize chemical potential energy without excessive wear in the gun chamber. Progressive-twist pressure-time curves are characterized by a more slowly rising pressure that tapers more gently, but its torque curve grows continuously during the interior ballistic cycle.

There have been some previous attempts at optimizing rifling to reduce force on the projectile, which increases projectile survivability. While effective in reducing rifling force, this design only concerns itself with projectile survivability and does not account for any pressure gains from the rifling scheme. In doing so, more propellant may be used at initial combustion but ballistic efficiency and piezometric efficiency do not necessarily benefit. In fact, this configuration loses the advantage of a large torque and pressure spike in the beginning of the ballistic cycle, so total work out of the propellant is reduced early in the cycle.

Accordingly, a need exists for a weapon with improved piezometric efficiency.

SUMMARY OF INVENTION

One aspect of the invention is a gun barrel having rifling with a variable twist rate. The gun barrel comprises an open-ended hollow cylinder extending along a longitudinal axis. The open-ended hollow cylinder includes a chamber end, a muzzle end and an interior surface. The interior surface defines rifling. The twist rate of the rifling varies along the longitudinal axis such that the rifling further comprises an elevated pressure region located at the chamber end and having a progressively increasing twist rate, a relief region having a progressively decreasing twist rate and a stabilizing region located at the muzzle end and having a twist rate equal to or less than the relief region. The progressively increasing twist rate is selected to induce a torque spike on a projectile. The progressively decreasing twist rate is selected to relieve the projectile from the torque spike and elevated stresses induced on the projectile towards a final twist rate. The twist rate of the stabilizing region is selected to stabilize the projectile.

Another aspect of the invention is a 40 mm gun barrel having rifling with a variable twist rate. The 40 mm gun barrel comprises an open-ended hollow cylinder extending along a longitudinal axis. The open-ended hollow cylinder includes a chamber end, a muzzle end and an interior surface. The interior surface defines rifling with a twist rate which varies along the longitudinal axis. The rifling further comprises an elevated pressure region located at the chamber end and having a progressively increasing twist rate from 48 inches per revolution to 24 inches per revolution, a relief region having a progressively decreasing twist rate from 24 inches per revolution to 48 inches per revolution and a stabilizing region located at the muzzle end and having a twist rate equal to or less than 48 inches per revolution.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A rifled weapon barrel increases the piezometric efficiency of the weapon system with varying rifling profiles throughout the barrel to maximize useful work out of the propellant gases. The weapon barrel includes a first rifling section, an elevated pressure region, at the breech end which progressively increases in twist rate to induce a torque spike on the projectile and maximize chamber pressure. Next, the weapon barrel includes a second rifling section, a relief region, which progressively decreases the twist rate to a level that, while may or may not be unsuitable for aerodynamic stability, allows for a maintained or slowed decrease torque curve and minimizes pressure loss behind the projectile. Finally, in a third region, a stabilizing region, the rifle then maintains or decreases this twist rate to increase stability of the projectile before exit.

A more piezometrically efficient gun can fire projectiles at the same or higher velocities while exhibiting greater longevity, depending on charge weight and operational needs. The interior ballistics produced by the variable rifling allow for a greater muzzle velocity for a given propellant volume, as more useful work is extracted from the burning propellant gases. While applicable to all calibers, this may be particularly useful for larger caliber cannons where increased range is important. Alternatively, less propellant can be used for a given muzzle velocity to decrease the severity of the ballistic conditions and increase barrel longevity. This can ultimately decrease the logistical footprint of the weapon system. Again, while weight savings are applicable to all caliber weapon systems, this may be particularly applicable to small caliber weapons where weight concerns can be paramount.

Figure 1:
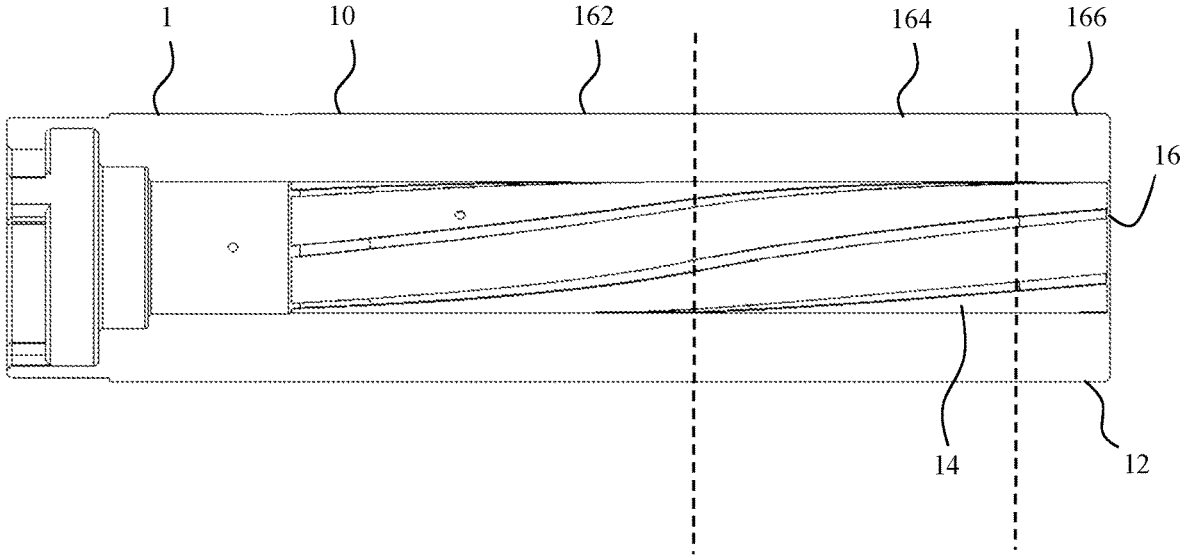
FIG. 1 is a cross-sectional view of a grenade launcher weapon barrel with variable rifling, according to an illustrative embodiment.

FIG. 1 is a cross sectional view of a grenade launcher weapon barrel with variable rifling, according to an illustrative embodiment. The weapon barrel 1 is an open ended cylinder extending along a longitudinal axis. The weapon barrel 1 further comprises a breech end 10, a muzzle end 12 and an interior surface 14. In the embodiment shown in FIG. 1, the weapon barrel 1 is for a 40 mm grenade launcher. However, this weapon barrel 1 is one embodiment, shown for illustrative purposes. The weapon barrel 1 is not limited to 40 mm grenade launchers. The weapon barrel 1 may be for weapon systems of any type or caliber which utilize a rifled barrel to project a projectile. The weapon barrel 1 may be for small caliber weapon systems, such as handguns, rifles and machine guns, for medium caliber weapon systems such as autocannons and large caliber weapon systems such as mortars, tanks and artillery cannons.

Figure 2:
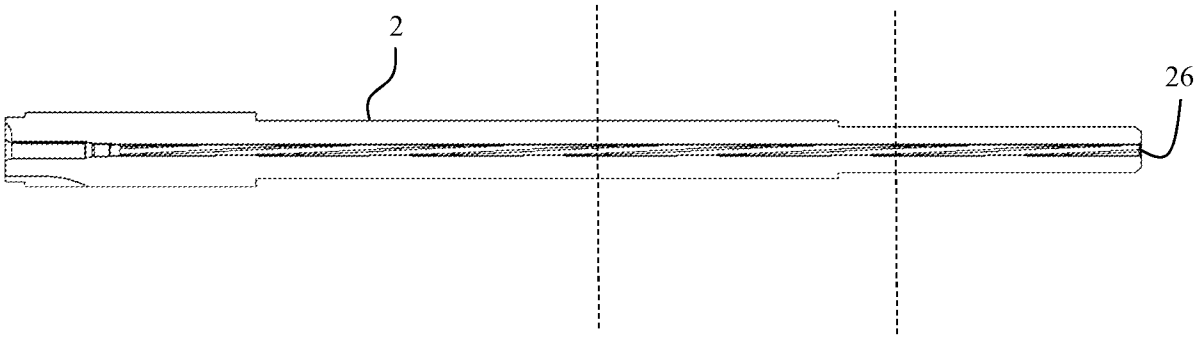
FIG. 2 is a cross-sectional view of a rifle weapon barrel with variable rifling, according to an illustrative embodiment.

For example, FIG. 2 is a cross-sectional view of a rifle weapon barrel with variable rifling, according to an illustrative embodiment. The rifle weapon barrel 2 comprises a rifling 26 profile which varies along the longitudinal axis as described further below in relation to the grenade launcher weapon barrel.

Further, the barrel is not limited to weapons. The variable rifling profile may be applied to any rifled barrel employed to propel a projectile and in which it is desired to increase piezometric efficiency.

Referring back to FIG. 1, the interior surface of the weapon barrel 1 defines rifling 16. The twist rate of the rifling 16 varies along the longitudinal axis to increase the piezometric efficiency of the weapon system. In one embodiment, the rifling 16 comprises an elevated pressure region 162, a relief region 164 and a stabilizing region 166 with varying twist rates.

The elevated pressure region 162 is located at the chamber end and has a progressively increasing twist rate. The progressively increasing twist rate is selected to induce an initial torque spike on the projectile and maximize chamber pressure.

The relief region 164 is positioned axially forward of the elevated pressure region 162 in a direction toward the muzzle. The relief region 164 is sized and dimensioned to level the pressure curve and has a progressively decreasing twist rate. The decreasing twist rate is selected to minimize pressure loss behind the projectile while relieving the extreme conditions induced in the elevated pressure region 164. This maintains the torque on the projectile increasing resistance in the bore and slowing down the projectile. This retardation in projectile motion allows the burning propellant to "catch up" with the projectile so that bore pressure can maintain its level or only minimally decrease thereby maximizing force on the projectile base. The higher pressure level then accelerates the projectile at a greater rate once bore resistance is relaxed. While not necessary, in some embodiments, the decreasing twist rate may be at a rate unsuitable for aerodynamic stability as the projectile will be stabilized further down the barrel 1.

The stabilizing region 166 is axially forward of the relief region 164 and adjacent the muzzle end 12 of the barrel 1. The stabilizing region 166 comprises a twist rate which is either constant at the final twist rate of the relief region 164 or decreases further. The constant twist rate section stabilizes the projectile spin for aeroballistic performance. This relief allows for the higher pressure downbore conditions without sacrificing exterior ballistic performance.

For each of the regions with varying twist rate, the twist rate may increase linearly, such as with a uniform, polynomial, or exponential rate of change. Alternatively, the twist rate may increase in a piecewise or segmented fashion to induce oscillations.

While the embodiment described above comprises three regions, the variable rifling 16 is not limited to three regions. In other embodiments, the variable rifling 16 may comprise more than three regions to further influence the interior ballistics of the weapon barrel 1.

In one embodiment, a 40 mm weapon barrel 1 has an elevated pressure region 162 which has a twist rate which decreases from 48 inches per revolution at the breech to 24 inches per revolution at the relief region 164. The relief region 164 has a twist rate which increases from 24 inches per revolution to 48 inches per revolution at the beginning of the stabilizing region 166. The stabilizing region 166 comprises a constant twist rate of 48 inches per revolution.

Figure 3:
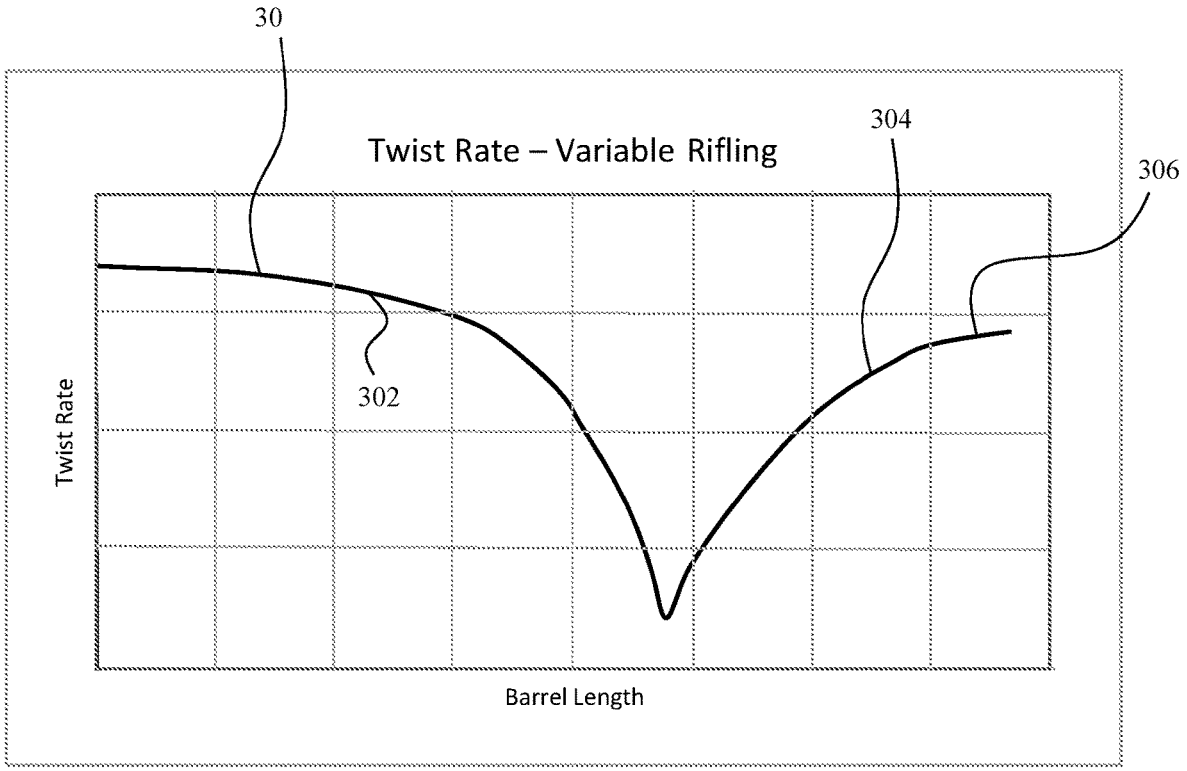
FIG. 3 is a graph plotting twist rate of rifling verses barrel length for a barrel with variable rifling, according to an illustrative embodiment.

FIG. 3 is a graph plotting twist rate of rifling verses barrel length for a barrel with variable rifling, according to an illustrative embodiment. As described above, graph 30 illustrates a plot having a portion 302 decreasing in magnitude and corresponding to the elevated pressure region 162 with a declining twist rate, a portion 304 increasing in magnitude and corresponding to the relief region 164 with an increasing twist rate and a portion 306 increasing at a slower rate than previously and corresponding to a stabilizing region 166. Alternatively, portion 306 may be flat and correspond to a stabilizing region 166 with a constant twist rate.

The elevated pressure region 162 is the longest region of the barrel to maximize the effect of the torque spike on the projectile. The relief region 164 is sized and dimensioned to be minimal while still relieving the conditions of the elevated pressure region. Finally, the stabilizing region is the shortest.

Within the variable rifling barrel 1, the muzzle pressure initially spikes to a maximum pressure due to the decreasing twist rate in the elevated pressure region 162 of the weapon barrel 1. This is similar to the initial muzzle pressure spike witnessed in barrels with constant twist rifling. As the maximum pressure is approximately the same as that witnessed in a traditional barrel, survivability of the projectile is not a concern.

In a traditional constant twist rifling barrel, the pressure quickly declines from the maximum. Within the variable rifling barrel 1, due to the increasing twist rate of the relief region 164, the initial pressure decline is much smaller in magnitude and then levels out at a pressure greater than for a constant twist barrel as the projectile traverses the relief region 164. While the twist rate may progress within the relief region 164 to a rate that is unsuitable for aeroballistic stability, it allows for level torque curve and minimizes pressure loss behind the projectile. This maintains the torque on the projectile, which the projectile has been shown to survive, increasing resistance in the bore and slowing down the projectile. This retardation in projectile motion allows the burning propellant to "catch up" with the projectile, so that the bore pressure can maintain its level or only minimally decrease, maximizing force on the projectile base. The higher pressure level will then accelerate the projectile at a greater rate once bore resistance is relaxed.

The pressure then gradually decreases from a local maximum as the projectile traverses the stabilizing region and stabilizes for muzzle exit.

While the peak pressure of the variable rifling barrel and constant rifling barrel is approximately the same, the average pressure of the variable rifling barrel 1 is higher in magnitude than the average pressure of the constant twist rifling barrel thereby increasing the piezometric efficiency in the variable rifling profile over the constant-twist rifling barrel.

While the invention has been described with reference to certain embodiments, numerous changes, alterations and modifications to the described embodiments are possible without departing from the spirit and scope of the invention as defined in the appended claims, and equivalents thereof.

What is claimed is:

1. A gun barrel having rifling with a variable twist rate, the gun barrel comprising:

an open-ended hollow cylinder extending along a longitudinal axis having a chamber end, a muzzle end and an interior surface;

said interior surface defining rifling wherein a twist rate of the rifling varies along the longitudinal axis such that the rifling further comprises a elevated pressure region located at the breech end and having a progressively increasing twist rate selected to induce a torque spike on a projectile, a relief region having a progressively decreasing twist rate selected to relieve the projectile of the torque spike toward a final twist rate and a stabilizing region located at the muzzle end and having a twist rate equal to or less than the relief region and selected to stabilize the projectile.

2. The gun barrel of claim 1 wherein the elevated pressure region has a progressively increasing twist rate which progresses from a first twist rate to a second twist rate.

3. The gun barrel of claim 2 wherein the elevated pressure region has a progressively increasing twist rate which linearly progresses from the first twist rate to the second twist rate.

4. The gun barrel of claim 2 wherein the elevated pressure region has a progressively increasing twist rate which progresses from a first twist rate to a second twist rate in a plurality of discrete segments.

5. The gun barrel of claim 2 wherein the gun barrel is a 40 millimeter gun barrel and wherein the first twist rate is 48 inches per revolution to 24 inches per revolution.

6. The gun barrel of claim 2 wherein the relief region has a progressively decreasing twist rate which progresses from the second twist rate to a third twist rate.

7. The gun barrel of claim 6 wherein the relief region has a progressively decreasing twist rate which linearly progresses from the second twist rate to the third twist rate.

8. The gun barrel of claim 7 wherein the relief region has a progressively decreasing twist rate which progresses from the second twist rate to the third twist rate in a plurality of discrete segments.

9. The gun barrel of claim 6 wherein the third twist rate is equal to the first twist rate.

10. The gun barrel of claim 6 the gun barrel is a 40 millimeter gun barrel and wherein the third twist rate is 24 inches per revolution.

11. The gun barrel of claim 2 wherein the stabilizing region has a constant twist rate.

12. The gun barrel of claim 11 wherein the stabilizing region has a constant twist rate at the third twist rate.

13. The gun barrel of claim 2 wherein the stabilizing region has a progressively decreasing twist rate.

14. The gun barrel of claim 13 wherein the stabilizing region has a progressively decreasing twist rate which progresses from the third twist rate to a fourth twist rate.

15. The gun barrel of claim 1 wherein the gun barrel is a small caliber gun barrel.

16. The gun barrel of claim 1 wherein the gun barrel is an artillery cannon.

17. A 40 mm gun barrel having rifling with a variable twist rate, the 40 mm gun barrel comprising:

an open-ended hollow cylinder extending along a longitudinal axis having a chamber end, a muzzle end and an interior surface;

said interior surface defining rifling wherein a twist rate of the rifling varies along the longitudinal axis such that the rifling further comprises a elevated pressure region located at the chamber end and having a progressively increasing twist rate from 48 inches per revolution to 24 inches per revolution, a relief region having a progressively decreasing twist rate from 24 inches per revolution to 48 inches per revolution and a stabilizing region located at the muzzle end and having a twist rate equal to or less than 48 inches per revolution.

* * * * *